United States Patent [19]

Young

[11] 4,132,315

[45] Jan. 2, 1979

[54] SECURITY RACK FOR WEAPONS

[75] Inventor: Bruce Young, Reading, Pa.

[73] Assignee: BMR Security Products Corp., Richmond, Ky.

[21] Appl. No.: 744,830

[22] Filed: Nov. 24, 1976

[51] Int. Cl.[2] ..... E05B 73/00; A47F 7/00

[52] U.S. Cl. ..... 211/4; 211/64

[58] Field of Search ..... 211/4, 7, 8, 9, 62, 211/63, 64, 68, 60 T, 60 SK, 60 R, 103, 208; 70/58, 59, 61, 62

[56] References Cited

U.S. PATENT DOCUMENTS

| | | | |
|---|---|---|---|
| 518,317 | 4/1894 | Hart | 211/4 |
| 554,252 | 2/1896 | Falk | 211/64 |
| 1,291,430 | 1/1919 | Davenport | 211/68 X |
| 1,757,600 | 5/1930 | Sprowle | 211/64 |
| 2,179,272 | 11/1939 | Poma | 211/4 |
| 2,251,271 | 8/1941 | Del Campo | 211/64 |
| 2,783,896 | 3/1957 | Agostini et al. | 211/64 |
| 2,855,108 | 10/1958 | Haapala | 211/64 |
| 2,946,452 | 7/1960 | Caloiero | 211/64 X |
| 2,998,885 | 9/1961 | Surface | 211/64 |
| 3,477,586 | 11/1969 | Haluska | 211/64 |
| 3,567,034 | 5/1971 | Mozelsio | 211/7 |
| 3,635,433 | 1/1972 | Anderson | 211/60 R X |
| 3,876,076 | 4/1975 | Hazelhurst | 211/4 |
| 3,917,071 | 11/1975 | Walters | 211/64 |

FOREIGN PATENT DOCUMENTS

| | | | |
|---|---|---|---|
| 50335 | 1/1911 | Switzerland | 211/62 |
| 174302 | 3/1935 | Switzerland | 211/8 |

*Primary Examiner*—Thomas J. Holko

*Attorney, Agent, or Firm*—Frailey & Ratner

[57] ABSTRACT

A multiweapon security rack having a plurality of adjustably positioned butt housings each for receiving a butt portion of an individual weapon. A bar enclosure housing is displaced from the butt housings and has a plurality of passages each for receiving a barrel section (which includes a shell tube, if applicable) of an individual one of the weapons. A securing assembly is manually operable for simultaneously blocking all of the passages thereby to capture and lock each of the barrel sections between a respective passage and the securing assembly.

11 Claims, 5 Drawing Figures

SECURITY RACK FOR WEAPONS

BACKGROUND OF THE INVENTION

A. Field of the Invention

This invention relates to security racks for weapons.

B. Prior Art

Multiweapon security racks have been known but have left much to be desired with regard to reliability, high security and ease and speed of operation. Prior multiweapon gun racks are shown, for example, in U.S. Pat. Nos. 2,251,271; 2,667,274; 2,855,108 and 2,958,422. To lock some prior racks, an unwieldy bar has been required where the bar must be inserted in place and then a shackle lock attached. Accordingly, these devices have not provided high security nor easy and fast access to the weapons. Other racks have undesirably required many separate parts or subassemblies in order to separately lock each of the weapons. A further limitation of prior multiweapon racks has been an inability to accommodate differing length weapons.

SUMMARY OF THE INVENTION

A security rack for a plurality of weapons having a plurality of butt housings each receiving a butt portion of an individual weapon. A barrel enclosure housing is displaced from the butt housing and has a plurality of passages each for receiving a barrel section of an individual one of the weapons. Securing means is manually operable for simultaneously blocking all of the passages for capturing and blocking each of the barrel sections between a respective passage and the securing means.

BRIEF DESCRIPTION OF THE DRAWINGS

FIG. 5 is a sectional view taken along lines 5—5 of FIG. 3.

DETAILED DESCRIPTION

Figures 1, 2, 4:
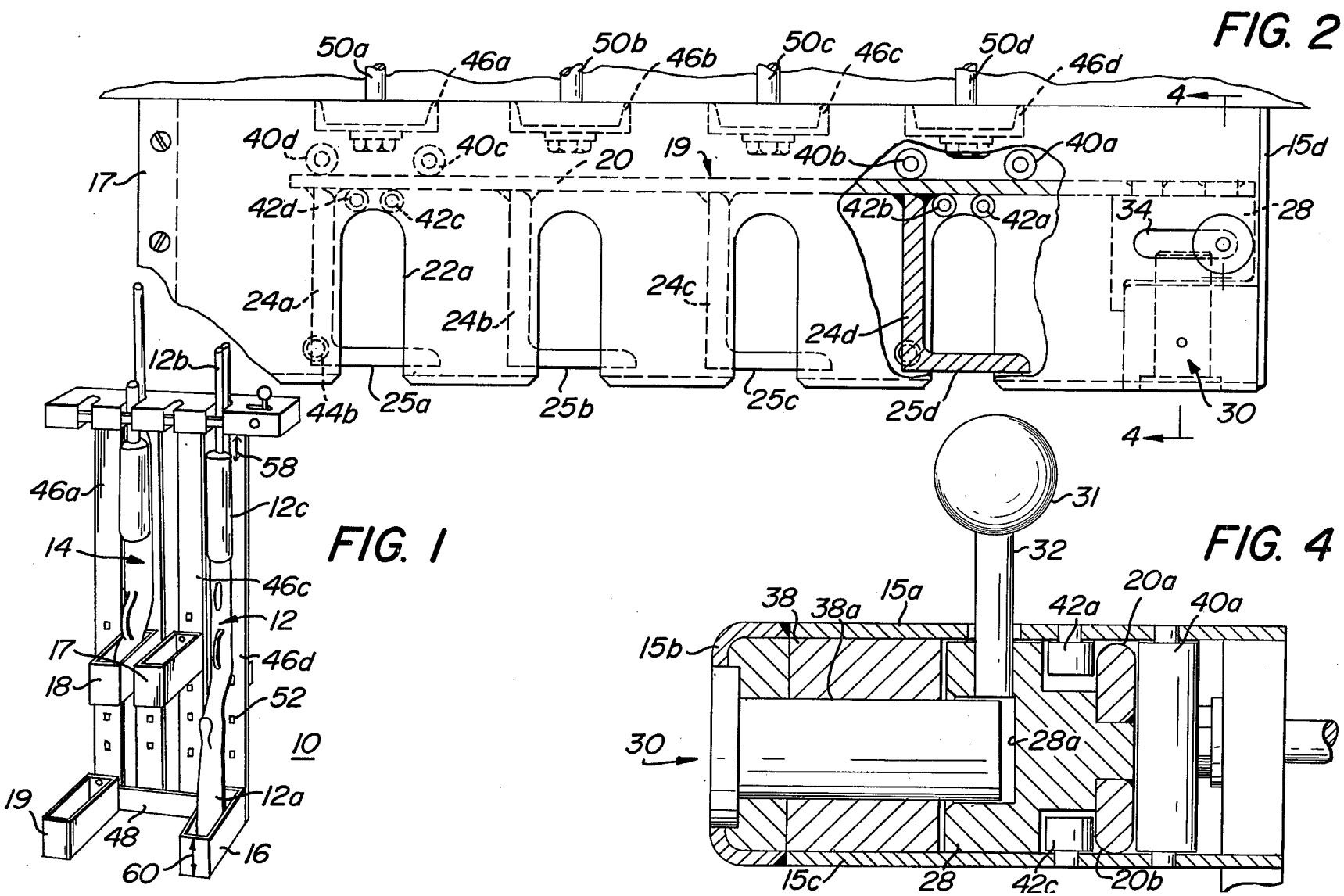
FIG. 1 is a perspective view of a multiweapon security rack according to the present invention.
FIG. 2 is an upper elevational view partly in section of the rack shown in FIG. 1.
FIG. 4 is a sectional view taken along lines 4—4 of FIG. 2.
Figure 3:
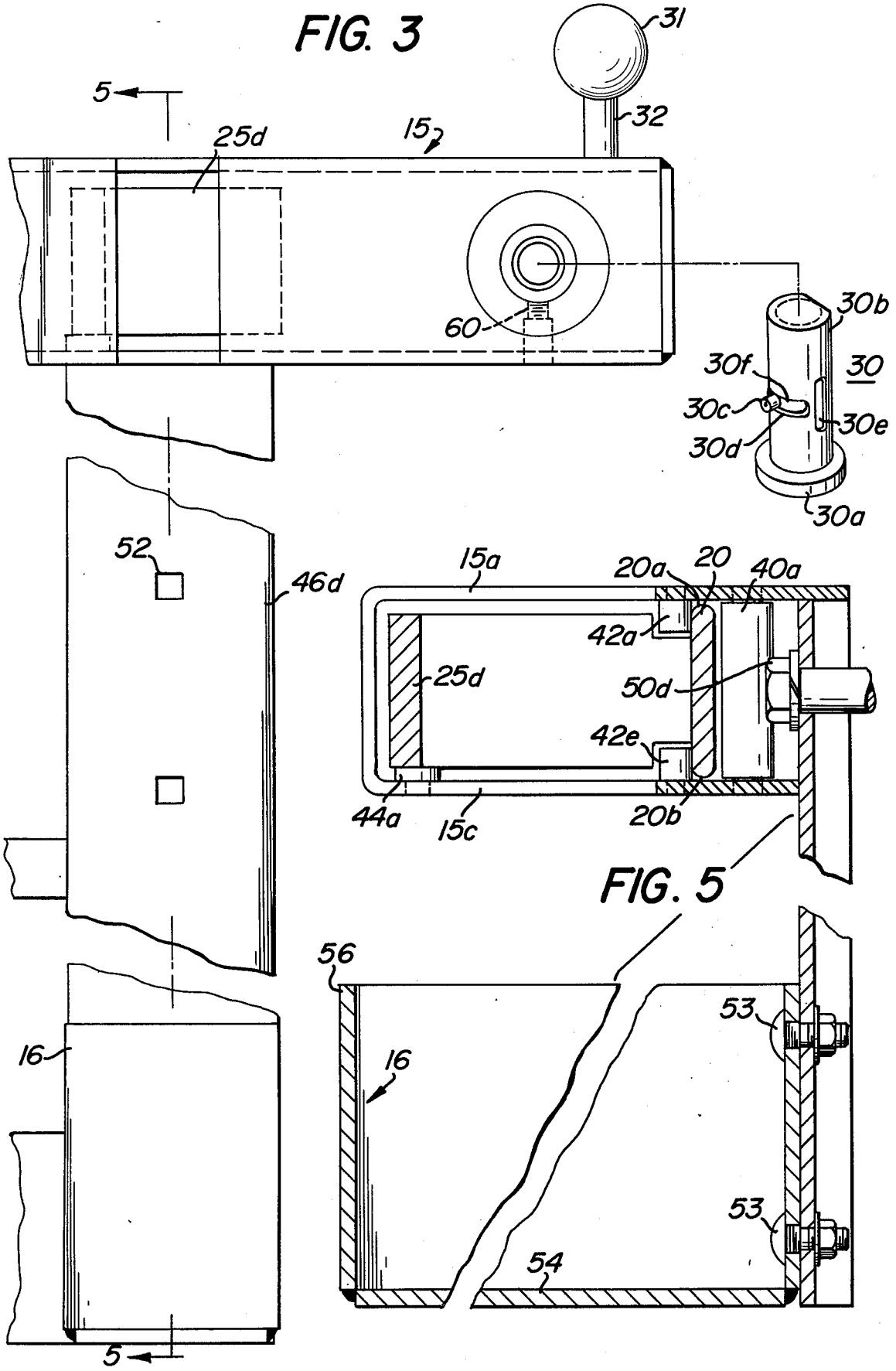
FIG. 3 is a front view showing in more detail a portion of the rack of FIG. 1.

Referring now to FIGS. 1–4, there is shown a security rack 10 for securing four weapons. Two of such weapons, viz, weapons 12 and 14 are illustrated as police type pump shotguns used for riot and disturbance control where weapon 14 is of the folding stock type. As will later be described in detail, differing length long guns such as shotguns and rifles may be accommodated and supported by means of adjustable butt housings 16–19. It will be understood that rack 10 may be adapted to secure more or less than four weapons but at least two.

Weapons 12 and 14 are securely retained and readily available in an emergency situation. With the pump of weapons 12, 14 in a retracted position, the weapons may be in a loaded condition but are unable to be fired while in rack 10 since a barrel enclosure housing 15 secures these weapons below the respective pump area. Further, with a single motion, rack 10 may be placed in the locked position for simultaneously securing all weapons and the rack may also be locked open for a standby condition.

Housing 15 is formed of an upper wall 15*a*, a front wall 15*b*, a lower wall 15*c* and a side wall 15*d*. An end plate 17 is securely fixed by screws to the side of housing 15 remote from side wall 15*d*. Front passage openings 22*a–d* are formed within the upper, front and lower walls 15*a–c* respectively of housing 15. Passages 22*a–d* are trough shaped and are adapted to be of sufficient width to receive a barrel and shell tube of an associated weapon in the manner illustrated in FIG. 1.

Housing 15 provides an enclosure for a securing assembly 19 which includes an extended bar member 20, "L" shaped members 24*a–d*, strike 28, lock housing 38 and bar lock 30 assembly. Bar member 20 extends throughout most of the longitudinal dimension of housing 15 with one end of each of "L" shaped securing members 24*a–d* being rigidly secured (as for example, by welding) to a front surface of member 20. Members 24*a–d* are fixed to member 20 so that in the illustrated lock position (FIG. 1) block legs 25*a–d* of members 24*a–d* respectively are effective to block passages 22*a–d* respectively. Strike 28 is rigidly secured to the front surface of member 20 adjacent the right hand end thereof to provide an opening 28*a* into which bar lock 30 may be introduced for locking as best illustrated in FIG. 4.

In order to manually move assembly 19, a handle is provided by a plastic ball 31 secured to the upper end of a rod 32 the lower end of which is rigidly secured within an upper opening of strike 28. In upper wall 15*a*, an opening 34 elongated in the longitudinal dimension of housing 15 allows freedom of longitudinal movement of rod 32 from the illustrated lock position to the full left or unlock position.

To provide for ease of movement and to guide securing assembly 19, the upper and lower surfaces 20*a,b* of elongated member 20 are rounded. In addition there are provided guide rollers 40*a–d* which are journaled within openings in upper and lower walls 15*a,b* of housing 15. Rollers 40*a–d* are effective to engage and guide the rear surface of member 20 while four pairs of guide buttons 42*a–h* engage and guide the front surface of member 20. Guide buttons 42*a–d* disposed as shown are journaled in upper wall 15*a* while guide buttons 42*e* and 42*f–h* (not shown) are jornaled in lower wall 15*c*. In order to provide for clearance for these guide buttons, sections of the "L" shaped members and strike 28 have cutouts adjacent member 20 as shown. To still further provide for the ease of sliding movement of assembly 19 there are provided slide buttons 44*a,b* which slidingly engage the lower edge of blocking legs 24*d,a* respectively.

Housing 15 is secured in position by four upright U-shaped channel members 46*a–d* which form a frame for rack 10. Upright channel members 46*a–d* may be rigidly secured to housing 15 as for example by welding to walls 15*a,c*. Members 46*a–d* extend downwardly and normal to the longitudinal dimension of housing 15 and are welded at their other end to a lower or floor channel member 48. Rack 10 may be securely bolted in place by means of attaching bolts 50*a–d* which extend through respective upper openings in members 46*a–d* where these openings are disposed behind respective blocking legs 25*a–d*. In this manner with assembly 19 in the locked position, screws 50*a–d* are effectively covered by and made substantially inaccessible by weapons secured by the blocking legs thereby to prevent unauthorized removal of rack 10.

Each of members 46*a–d* has a series of bolt openings 52 to accommodate carriage bolts and nuts 53 which secure butt housings 16–19 in place at a desired position. Each of butt housing 16–19 are identical and only one of them need be described in detail. As shown in FIGS. 1 and 5, butt housing 16 forms an open ended or open top chamber for longitudinal insertion of a portion of butt 12*a* of weapon. In this manner, housing 16 forms a partial enclosure for the butt having a bottom wall 54 joined to side wall 56 in a manner so that butt 12*a* may be inserted therein with the lowermost surface of the butt lying adjacent a bottom wall 54.

It will be seen in FIG. 1 with weapon 12 in place that butt end 12*a* is within butt housing 16 and that barrel and shell tubes 12*b* are secured within passage 22*d*. This barrel and shell portion 12*b* may be said to be a first section which extends to a second section 12*c* (fore end) which is of increased diameter or dimension with respect to the dimension of first section 12*b*. Butt housing 16 is positioned and secured on frame 46*d* so that distance 58 between the upper end of section 12*c* and lower wall 15*c* is less than the weapon longitudinally directed internal butt housing dimension 60. In this manner with weapon 12 secured in rack 10 and locked, weapon longitudinal movement will be dictated by distance 58 with second section 12*c* abutting against housing lower wall 15*c* and not passing through passage 22*d*. With distance 58 made less than dimension 60, it will be understood that when section 12*c* abutts against surface 15*c*, a portion of butt 12*a* will still be maintained within the butt housing thereby preventing the removal of the weapon. Similarly with weapon 14 (folded butt), butt housing 18 is adjusted as illustrated in order to perform the above described function.

As shown in more detail in U.S. Pat. No. 3,921,422, bar lock 30 assembly comprises a tube 30*b* having an extended flange 30*a* (for increased security from prying) a longitudinally oriented groove 30*e* and a transverse opening 30*d* through which a laterally movable locking pin 30*c* projects. Locking pin 30*c* is rigidly secured to and extends from an inner lock plug 30*f*. Tube or sleeve 30*b* fits within a bore opening 38*a* in lock housing 38. Specifically, locking pin 30*c* protrudes either through a longitudinal directed slot or in either of two substantially parallel transverse slots communicating with the longitudinal slot all formed in the wall of bore opening 38*a*. The outermost transverse slot is the one which enables bar lock 30 to be kept at its outer unlocked position when the key has been turned and pin 30*c* is slid outwardly along the longitudinal slot until it intersects the outermost transverse slot. The inner transverse slot is the one that maintains the lock in its innermost locked position (engaging the walls of opening 28*a*) when engaged by pin 30*c*. A set screw 60 extends through and threadedly engages lock housing 38. Set screw 60 extends into groove 30*e* and permits the partial longitudinal movement of lock 30 in the manner previously described.

As previously described, bar lock 30 may be locked as illustrated in FIGS. 2 and 4 thereby locking securing assembly 19 in its passage blocking or locking position. This blocking position may be achieved by a substantially single motion from the unblock position in which securing assembly 19 is in its left hand position and bar lock 30 is open. To operate, handle 31 may simply be pushed to the right and bar lock 30 placed in its locked position with a key thereby to capture and lock the weapons. On the other hand, with securing assembly 19 in its left hand unblocking position, bar lock 30 may also be locked since it clears the right hand face of strike 28. In this unblocking position, securing assembly 19 has been locked open for standby and cannot be moved to the blocking position without the key. In a further embodiment, if bar lock 30 were of the latch bolt type as set forth, for example, in U.S. Pat. Nos. 3,711,894 and 3,827,266, the operation from unblock to block would be to push handle 31 to the right and at the same time push in the bar lock with the other hand.

What is claimed is:

1. A security rack for a plurality of weapons each having a front and a butt portion, said front portion being formed of a first barrel section having a predetermined diameter and a second section having an increased diameter with respect to that of said first section comprising:

a plurality of butt housings each for receiving a butt portion of an individual one of said weapons, a barrel enclosure housing displaced from said butt housings having a plurality of passages each for receiving a first section of an individual one of said weapons, securing means fixed to a movable member operable for simultaneously blocking said passages for capturing and locking said first sections between said passages and said securing means, a strike member secured to said movable member, bar lock means movable within said barrel enclosure housing (1) for engagement with said strike member when said bar lock means is in a locked position thereby to constrain said securing means in a blocked position fo simultaneously blocking all said passages and (2) for disengagement from said strike member when said bar lock means is unlocked and pulled outwardly to an open position thereby allowing said securing means to be moved to an unblocked position, said strike member being concealed by said housing and said bar lock means in said blocked position and being concealed by said housing in said unblocked position, said strike member having an additional portion for engaging said bar lock means when the securing means is in the unblocked position and the bar lock means is moved to the locked position thereby to lock said securing means in the unblocked position.

2. The security rack of claim 1 in which said securing means comprises a plurality of angle members rigidly secured to said movable member whereby (1) in said blocked position each of said angle members blocks a respective passage and (2) in unblocked position, unblocks said passage.

3. The security rack of claim 2 in which each of said angle members is an L-shaped member, said movable member extending longitudinally within said barrel enclosure housing and one end of each of said L-shaped members being rigidly secured to said movable member whereby the remote leg of each L-shaped member operates as a passage blocking leg.

4. The security rack of claim 3 in which said strike member is formed to clear the bar lock means when the securing means is in the unblocked position and the bar lock means is moved to the locked position thereby to lock said securing means in the unblocked position.

5. The security rack of claim 1 in which said bar lock means includes latch bolt means not requiring key actuation for locking whereby the securing means may be moved from an unblocked position to a blocked position and the bar lock means moved to the locked position without key actuation.

6. The security rack of claim 3 in which there is provided handle means secured to said strike member for moving said movable member between said blocked and unblocked positions.

7. The security rack of claim 1 in which there is provided roller means secured to said barrel enclosure housing for engaging opposing surfaces of said movable member for providing ease of movement of said movable member.

8. The security rack of claim 5 in which there is provided frame means secured to said barrel enclosure housing and means for adjustably securing each of said butt housings to said frame means in accordance with the length of an individual weapon, said adjustable securing means being disposed behind and concealed by said weapons when said weapons are secured in said rack.

9. The security rack of claim 8 in which said frame means comprises a plurality of frame members and means for securing each of said butt housings to an individual frame member so that said second section of a weapon is held a predetermined distance from said barrel enclosure housing with said predetermined distance being less than the depth of said butt housing in the long dimension of said weapon.

10. The security rack of claim 9 in which there is provided openings in said frame means to receive screws to attach said frame means to a wall, said openings being disposed behind said passages thereby to be inaccessible when said weapons are secured in said rack.

11. A security rack for a plurality of weapons each having a front and a butt portion, said front portion being formed of a first barrel section having a predetermined diameter and a second section having an increased diameter with respect to that of said first section comprising:

a plurality of butt housings each for receiving a butt portion of an individual one of said weapons, a barrel enclosure housing displaced from said butt housings having a plurality of passages each for receiving a first section of an individual one of said weapons, securing means fixed to a movable member having blocking legs, operable for simultaneously blocking said passages for capturing and locking said first sections between said passages and said blocking legs, a strike member secured to said movable member, bar lock means movable within said barrel enclosure housing (1) for engagement with said strike member when said bar lock means is in a locked position thereby to constrain said securing means in a blocked position for simultaneously blocking all said passages with said blocking legs and (2) for disengagement from said strike member when said bar lock means is unlocked and pulled outwardly to an open position thereby allowing said securing means to be moved to an unblocked position in which said blocking legs no longer block the passages, said strike member being concealed by said housing and said bar lock means in said blocked position and being concealed by said housing in said unblocked position, and fastening devices for securing said barrel enclosure housing in place to a rigid structure, said fastening devices being disposed behind said passages and behind respective blocking legs whereby said fastening devices are substantially inaccessible with said blocking legs blocking said passages in said blocked position.

* * * * *